US012195971B2

(12) United States Patent
Inzitari

(10) Patent No.: US 12,195,971 B2
(45) Date of Patent: Jan. 14, 2025

(54) DOWNPIPE VALVE CONTROL SYSTEM

(71) Applicant: FIRE HALO PTY LTD, South Bowenfels (AU)

(72) Inventor: Frank Inzitari, South Bowenfels (AU)

(73) Assignee: FIRE HALO PTY LTD, South Bowenfels (AU)

( * ) Notice: Subject to any disclaimer, the term of this patent is extended or adjusted under 35 U.S.C. 154(b) by 0 days.

(21) Appl. No.: 18/547,799

(22) PCT Filed: Mar. 17, 2022

(86) PCT No.: PCT/AU2022/050232
§ 371 (c)(1),
(2) Date: Aug. 24, 2023

(87) PCT Pub. No.: WO2022/198262
PCT Pub. Date: Sep. 29, 2022

(65) Prior Publication Data

US 2024/0133182 A1 Apr. 25, 2024
US 2024/0229469 A9 Jul. 11, 2024

(30) Foreign Application Priority Data

Mar. 24, 2021 (AU) ..... 2021900865

(51) Int. Cl.
*E04D 13/08* (2006.01)

(52) U.S. Cl.
CPC ..... *E04D 13/08* (2013.01); *E04D 2013/0853* (2013.01)

(58) Field of Classification Search
CPC ..... E04D 13/08; E04D 13/076; E04D 2013/0853; E04D 2013/082; E03B 3/03; E03B 2001/047
See application file for complete search history.

(56) References Cited

U.S. PATENT DOCUMENTS 1,366,591 A * 1/1921 Passano ..... F23Q 9/06 431/106
4,150,793 A * 4/1979 Russo ..... E04D 13/0765 239/66

(Continued)

FOREIGN PATENT DOCUMENTS

AU 782888 B2 9/2005
AU 2015100859 A4 7/2015

(Continued)

OTHER PUBLICATIONS

International Preliminary Report on Patentability (Chapter II) dated Oct. 5, 2022 from PCT Application No. PCT/AU2022/050232.

(Continued)

*Primary Examiner* — Patrick C Williams
(74) *Attorney, Agent, or Firm* — INNOVATION CAPITAL LAW GROUP, LLP; Vic Lin

(57) ABSTRACT

A downpipe valve control system has a main body having an inlet and an in-line outlet configurable for fluidly connective installation as part of a downpipe. The main valve also has a main valve handle therefor operative between the inlet and the outlet. The system also has an attachable spigot having a removeable proximal cap interfacing a proximal port of the main body. The proximal has a diameter greater than 7 cm and a distal inlet port for a water hose can be connected to the proximal cap. The present arrangement can be used for cleaning gutters, flushing rainwater tanks and/or mitigating against ember attack.

16 Claims, 2 Drawing Sheets

(56) References Cited

U.S. PATENT DOCUMENTS

| | | | | |
|---|---|---|---|---|
| 5,906,732 | A * | 5/1999 | Kohno | B07C 5/361 210/138 |
| 6,047,729 | A * | 4/2000 | Hollister | F17C 13/025 137/557 |
| 6,058,975 | A * | 5/2000 | Hui-Chen | F16K 11/20 285/133.4 |
| 6,526,699 | B1 * | 3/2003 | Foglio, Sr. | E03B 3/03 52/16 |
| 7,025,879 | B1 * | 4/2006 | Ticknor | E03B 3/03 210/474 |
| D1,039,652 | S * | 8/2024 | Keillor | D23/207 |
| 2005/0257433 | A1 | 11/2005 | Dussault et al. | |
| 2008/0314466 | A1 * | 12/2008 | Cimberio | F16K 11/20 137/883 |
| 2009/0031625 | A1 * | 2/2009 | McAvoy | A01G 25/00 52/12 |

FOREIGN PATENT DOCUMENTS

| | | | |
|---|---|---|---|
| AU | 2020101488 | A4 | 9/2020 |
| WO | 9523263 | A1 | 8/1995 |
| WO | 2019084596 | A1 | 5/2019 |

OTHER PUBLICATIONS

International Search Report & Written Opinion dated Apr. 13, 2022 from PCT Application No. PCT/AU2022/050232.

* cited by examiner

DOWNPIPE VALVE CONTROL SYSTEM

FIELD OF THE INVENTION

This invention relates generally to a downpipe valve control system which may be used for cleaning gutters, flushing rainwater tanks and/or mitigating against ember attack.

BACKGROUND OF THE INVENTION

Silt and debris build-up in gutters necessitates periodic cleaning. Usually, one can climb atop a ladder and use a hose to spray debris therefrom.

However, gutter guards may hinder such a process and silt build-up may be difficult to dislodge.

The present invention seeks to provide a way which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

There is provided herein a downpipe valve control system comprising a main body comprising an inlet and an in-line outlet. The main body is thus configurable for fluidly connective installation as part of a downpipe.

The main body further comprises a main valve and main valve handle therefor. The main valve is operative between the inlet and the outlet.

The system further comprises an attachable spigot comprising a proximal cap attachable to a proximal port of the main body. The proximal port is openly fluidly connective to the inlet. The proximal port has a diameter greater than 7 cm, preferably approximately 10 cm or more.

The spigot further comprises a distal inlet port fluidly connective with the proximal cap and which is attachable to a water hose (such as a conventional garden hose) in use.

The valve control system may be installed on each downpipe of guttering and wherein only one thereof need necessarily comprise the spigot.

Once installed, the main valve may be left open to allow the downpipe to function in the normal manner.

However, for periodic gutter cleaning, the main valve may be closed by turning the handle through 90° and the spigot valve opened by turning the spigot valve handle through 90°. A water hose may be connected to the distal inlet port. The distal inlet port may comprise a quick fit garden hose connector allowing attachment of a garden hose thereto.

Water may flow via the spigot to flood upper sections of the downpipes and gutters thereabove.

Water may be left pooled for some time to loosen accumulated silt.

The cap may then be quickly removed to create a rush of water from the proximal port wherein the torrent of water created thereby assists in washing away debris and loosening silt accumulated in the gutters and/or downpipes.

The proximal port may comprise a diameter of greater than 7 cm, preferably approximately 10 centimetres to allow adequate flow for this purpose.

Once the water is drained from the upper sections of the downpipes and the gutters, the cap may be replaced, the spigot valve closed and the main valve opened. Prior replacing the cap, one's hand may be inserted through the proximal port to remove any remaining debris collected atop the main valve.

The present downpipe valve control system may be further used for flushing water tanks. Specifically, the main body may be similarly installed in-line in a downpipe leading to a rainwater tank. The main valve may be closed and a water hose connected to the distal inlet port to flood the downpipe (and preferably gutters) thereabove.

Thereafter, the main valve may be open to create a rush of water which flows through the downpipe into the rainwater tank to flush silt and/or debris collected therein.

The main valve preferably comprises a ball valve to allow unobstructed flow through the main valve. Furthermore, the main valve preferably defines an interior channel having a diameter not less than that of the downpipe to allow adequate flow therethrough.

In a yet further application, the present downpipe valve control system to be used for mitigating against ember attack wherein the main valve may be closed and a water hose connected to the distal inlet port to flood the downpipe and gutters thereabove.

The spigot valve may then be closed and the water hose removed, thereby leaving a pool of water within the gutters which would extinguish any embers falling therein.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
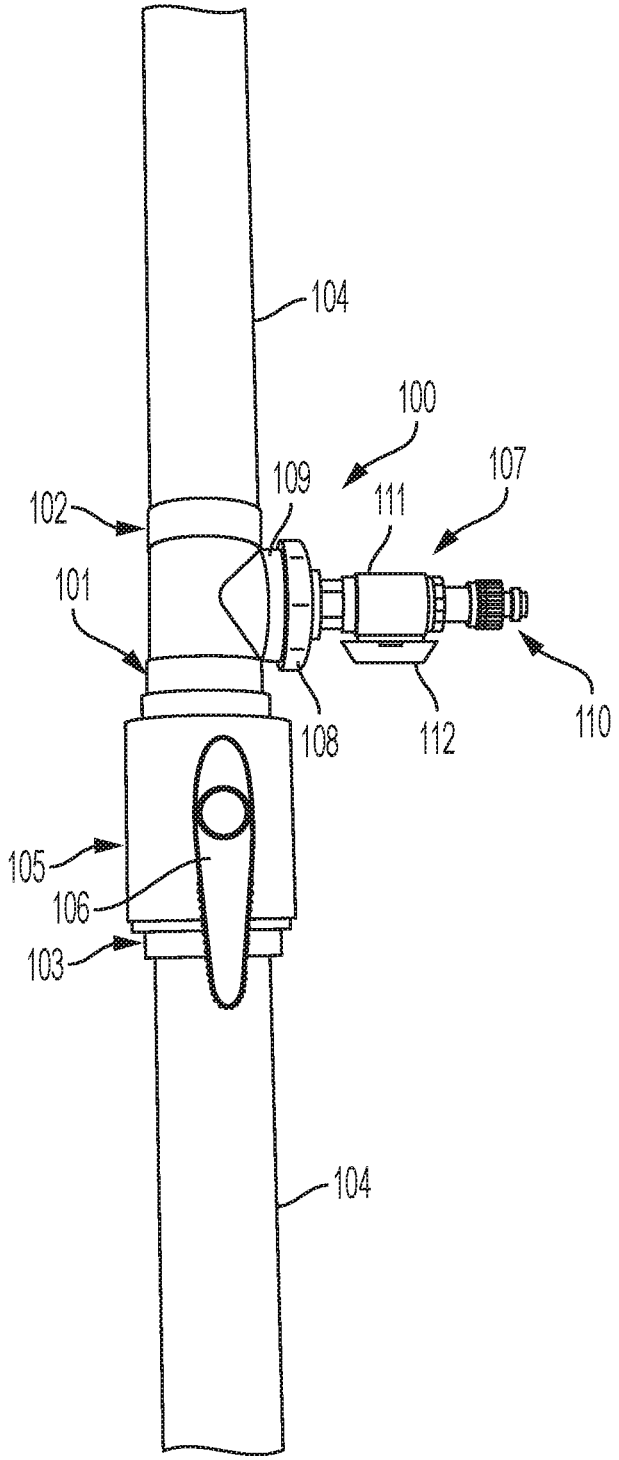
FIG. 1 shows a gutter valve control system in accordance with an embodiment.

A gutter valve control system 100 comprises a main body 101 comprising an inlet 102 and an in-line outlet 103. The main body 101 is thus configurable for fluidly connective installation as part of a downpipe 104 in the manner shown in FIG. 1.

The main body 101 further comprises a main valve 105 and main valve handle 106 therefor. The main valve 105 is operative between the inlet 102 and the outlet 103. Preferably the main valve 105 defines a channel therethrough having a diameter not less than that of the downpipe 104 to reduce obstruction of water flow through the downpipe 104 and/or to avoid trapping debris therein.

The system 100 further comprises an attachable spigot 107 comprising a proximal cap 108 attachable to a proximal port 109 of the main body 101. The proximal port 109 is openly fluidly connective to the inlet 102. Furthermore, the proximal port 109 has a diameter greater than 7 cm, preferably 10 cm or more to allow sufficient flow of water therefrom and insertion of a hand therethrough.

The spigot 107 further comprises a distal inlet port 110 fluidly connected with the proximal cap 108. The distal inlet port 110 is attachable to a water hose in use. In the embodiment shown, the distal inlet port 110 comprises a quick fit garden hose connector.

The spigot 107 further comprises a spigot valve 111 and handle 112 therefor. The spigot valve 111 is operative between the distal inlet port 110 and the proximal cap 108.

The system 100 would be installed on every downpipe 104 of a gutter system. Each system 100 may comprise the spigot 107. However, in embodiments, only one or a subset of the gutter systems 100 comprise the spigot 107 whereas the others comprise a blank cap 108 (i.e. without a spigot) or no cap 108 and port 109 at all.

Cleaning gutters using the system 100 may comprise installing the main body 101 in-line in an existing downpipe 104 in the manner shown in FIG. 1. The cross-section of the inlet 102 and the outlet 103 match that of the downpipe 104 which, in the embodiment shown in FIG. 1 is circular.

In use, the main valve 105 may be left open (that is with the main valve handle 106 orientated vertically as is shown in FIG. 1) so that water collected by gutters thereabove may flow through the downpipe 104 in the normal manner. The cap 108 may be attached to the port 109 and the spigot valve 111 kept closed.

Periodically, for gutter cleaning, the main valve 105 may be closed by turning the handle 106 through 90°, the spigot valve 112 opened by turning the spigot valve handle 112 through 90° and a water hose (not shown) connected to the distal inlet port 110. As alluded to above, one or only a subset of valve control systems 100 may comprise the spigot 107.

Water may flow via the water hose and through the spigot 107 to flood the upper section of the downpipe 104 and gutters thereabove. Water may be provided until overflow from the gutters is seen.

The gutters and downpipes 104 may be left flooded for some time to loosen any silt that may have accumulated therein.

The cap 108 may then be removed to create a rush of water to flow from the port 109, wherein the water torrent created thereby assists in washing away and loosening any silt and/or debris collected in the gutters and downpipes 104. The cap 108 may be removed by unscrewing the threading thereof from the threading of the port 109.

Once the water has drained, the cap 108 may be replaced, the spigot valve 111 closed in the main valve 105 opened.

This gutter cleaning procedure may be conducted every month for example.

In accordance with a further application, the downpipe valve control system 100 may be used for flushing silt and/or debris from rainwater tanks. In accordance with this application, as opposed to removing the cap 108, the main valve 105 may be quickly opened after having flooded the downpipes 104 and gutters thereabove.

The opening of the main valve 105 creates a sudden torrent of water to flow down the downpipe 104 into a water tank there underneath which may flush silt and/or debris therefrom.

Preferably the main valve 105 defines a channel therethrough not being less than the diameter of the downpipe 104 to maximise the water flow therethrough during this operation. Further preferably, the main valve 105 comprises a valve to allow unobstructed flow therethrough.

In accordance with a yet further application, the downpipe valve control system 100 may be used for prevention against ember attack in the event of bushfire.

In accordance with this application, the main valve 105 may be closed and a garden hose connected to the spigot 107 to flood the downpipes 104 and gutters thereabove.

Once the downpipes 104 and gutters thereabove are flooded, the spigot valve 111 may be closed by turning the handle 112 thereof through 90° and the garden hose removed from the distal inlet port 110 thereby retaining a pool of water within the gutters which would extinguish any embers falling therein.

Figure 2:
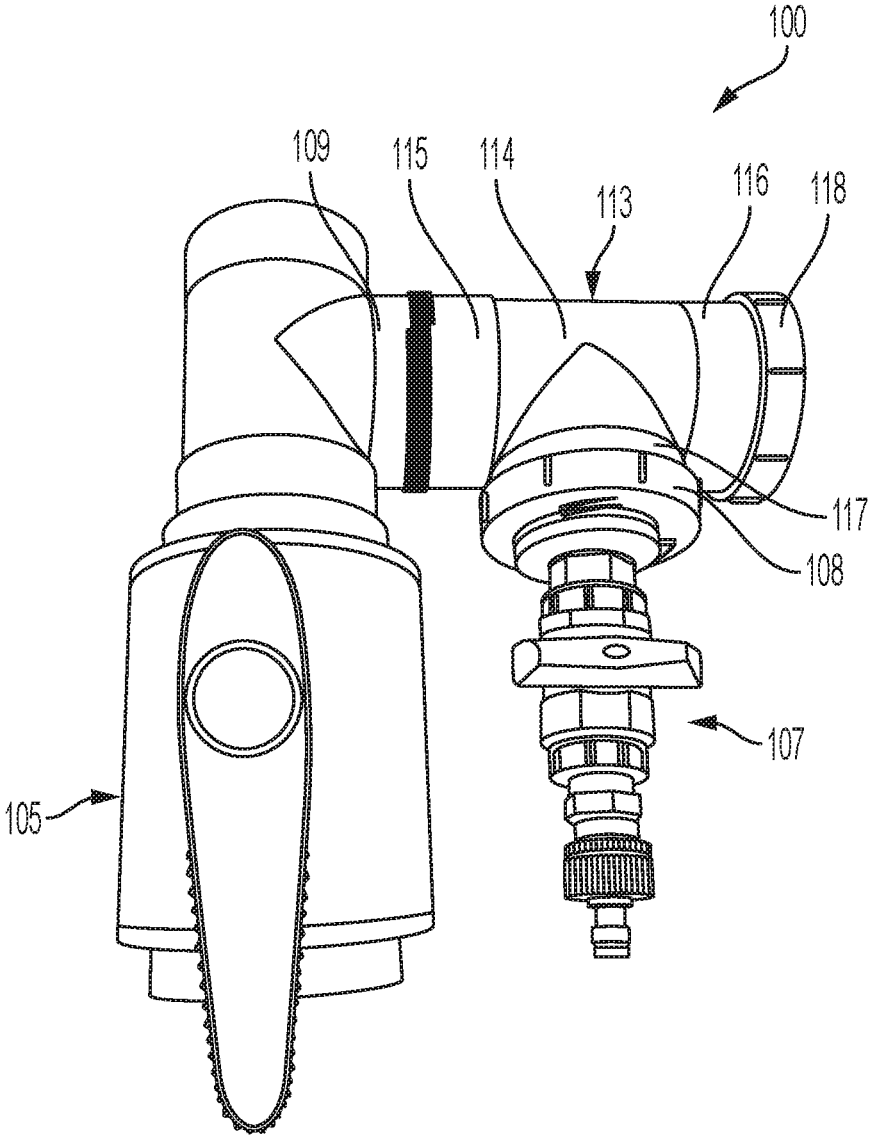
FIG. 2 shows a gutter valve control system in accordance with a further embodiment.

FIG. 2 shows the downpipe valve control system 100 in accordance with a further embodiment. In accordance with this embodiment, the spigot 107 is mounted parallel with respect to the main valve 105 from a T-piece 113.

A through section 114 may comprise a proximal end 115 attachable to the port 109. The proximal end 115 may be permanently attached to the port 109. However, in embodiments, the proximal end 115 may be removed from the port 109.

Furthermore, in embodiments, the proximal end 115 may be attached to the port 109 at various rotational offsets to adjust the direction of the spigot 107. In other words, the spigot 107 can be orientated from the T-piece 113 on a plane perpendicular with a longitudinal axis of the downpipe 104. For example, the spigot 107 may be orientated through 90° with respect to the orientation shown in FIG. 2 if desirous.

The spigot 107 may yet emanate from the proximal cap 108 attached to an orthogonal section 117 of the T-piece 113. In other words, the proximal cap 108 may be removed in the manner described above to create the surge of water.

Furthermore, a distal end 116 of the through section 114 of the T-piece 113 may comprise a further proximal cap 118. The further proximal cap 118 may be removed in the aforedescribed manner create the surge of water.

In further a variation of the embodiment shown in FIG. 2, the main valve 105 may locate upstream of the spigot 107, an arrangement especially suited for installations where the downpipe 8 shown feeds from a number of downpipes into a water tank and wherein one main valve 105 may be used to charge/fill all of the downpipes with water.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The term "approximately" or similar as used herein should be construed as being within 10% of the value stated unless otherwise indicated.

The invention claimed is:

1. A method of cleaning gutters using a downpipe valve control system, the downpipe valve control system having:

an inlet and an in-line outlet;

a T-piece having:

a through section comprising:

a proximal end fluidly coupled between the inlet and the outlet; and a distal end interfacing a removeable cap; and an orthogonal section between the proximal and distal ends; and a spigot fluidly connecting the orthogonal section; and a main valve operative between the outlet and the proximal end, the method comprising:

installing the inlet and in-line outlet in the downpipe, closing the main valve, connecting a water hose to the spigot to flood the downpipe and gutters thereabove, and removing the cap to create a rush of water from the cap to dislodge silt and/or debris collected in the gutters.

2. The method as claimed in claim 1, wherein removing the cap comprises unscrewing the cap from threading of the distal end.

3. The method as claimed in claim 1, wherein the proximal end has a diameter greater than 7 cm.

4. The method as claimed in claim 1, wherein the proximal end has a diameter of approximately 10 cm or greater.

5. The method as claimed in claim 1, wherein in the spigot has a spigot valve and a distal inlet port.

6. The method as claimed in claim 1, wherein the main valve defines a channel therethrough, the channel not being less in diameter than that of the downpipe.

7. The method as claimed in claim 1, wherein the main valve is a ball valve.

8. The method as claimed in claim 1, wherein the inlet and outlet have a cross-section matching that of the downpipe.

9. The method as claimed in claim 1, wherein the spigot is attached to the orthogonal section by a further removeable cap.

10. The method as claimed in claim 1, wherein the spigot is mounted parallel with respect to the main valve from the T-piece.

11. The method as claimed in claim 1, wherein the spigot is orientated from the T-piece on a plane perpendicular with a longitudinal axis of the downpipe.

12. The method as claimed in claim 1, wherein the proximal end is permanently attached between the inlet and the outlet.

13. The method as claimed in claim 1, wherein the proximal end is removably attached between the inlet and the outlet.

14. A method of flushing rainwater tanks using a downpipe valve control system, the downpipe valve control system having:

an inlet and an in-line outlet;

a T-piece having:

a through section comprising:

a proximal end fluidly coupled between the inlet and the outlet; and a distal end interfacing a removeable cap; and an orthogonal section between the proximal and distal ends; and a spigot fluidly connecting the orthogonal section; and a main valve operative between the outlet and the proximal end, the method comprising:

installing the inlet and in-line outlet in the downpipe;

closing the main valve, connecting a water hose to the spigot to flood the downpipe thereabove, opening the main valve to create a rush of water which flows through the downpipe into the rainwater tank to flush silt and/or debris accumulated therein.

15. A method of mitigating against ember attack using a downpipe valve control system, the downpipe valve control system having:

an inlet and an in-line outlet;

a T-piece having:

a through section comprising:

a proximal end fluidly coupled between the inlet and the outlet; and a distal end interfacing a removeable cap; and an orthogonal section between the proximal and distal ends; and a spigot fluidly connecting the orthogonal section; and a main valve operative between the outlet and the proximal end, the method comprising:

providing the downpipe valve control system below and in fluid communication with a plurality of gutters;

installing the inlet and in-line outlet in the downpipe, closing the main valve, and connecting a water hose to the spigot to flood the downpipe and gutters thereabove.

16. The method as claimed in claim 15, wherein in the spigot has a spigot valve and wherein the method further comprises closing the spigot valve and detaching the water hose from the spigot.

* * * * *